US005266001A

United States Patent [19]

Kanayama et al.

[11] Patent Number: 5,266,001

[45] Date of Patent: Nov. 30, 1993

[54] WORKING MACHINE FOR CONSTRUCTION VEHICLES AND METHOD OF OPERATING THE SAME

[75] Inventors: Noboru Kanayama, Kanagawa; Hisashi Fukumoto, Tokyo; Kuniharu Fujii, Ishikawa, all of Japan

[73] Assignee: Kabushiki Kaisha Komatsu Seisakusho, Japan

[21] Appl. No.: 962,013

[22] Filed: Oct. 15, 1992

Related U.S. Application Data

[63] Continuation of Ser. No. 476,447, Jul. 11, 1990, abandoned.

[30] Foreign Application Priority Data

| | | | |
|---|---|---|---|
| Nov. 26, 1987 | [JP] | Japan | 62-299465 |
| Nov. 26, 1987 | [JP] | Japan | 62-299466 |
| Jan. 28, 1988 | [JP] | Japan | 63-018231 |

[51] Int. Cl.[5] ..... E02F 3/28

[52] U.S. Cl. ..... 414/694; 212/270

[58] Field of Search ..... 414/694, 695.5, 718, 414/728; 212/270, 261, 238, 188, 187

[56] References Cited

U.S. PATENT DOCUMENTS

| | | | |
|---|---|---|---|
| 3,536,216 | 10/1970 | Aurora et al. | 414/694 |
| 3,674,162 | 7/1972 | Smith | 414/694 |
| 3,680,722 | 8/1972 | Symmank | 414/694 |
| 4,358,240 | 11/1982 | Shumaker | 414/694 |
| 4,679,336 | 7/1987 | Brocklebank | 414/694 X |

FOREIGN PATENT DOCUMENTS

| | | | |
|---|---|---|---|
| 1185523 | 1/1965 | Fed. Rep. of Germany . | |
| 2459489 | 1/1976 | Fed. Rep. of Germany . | |
| 2714453 | 10/1977 | Fed. Rep. of Germany | 414/694 |
| 2822110 | 12/1978 | Fed. Rep. of Germany | 212/188 |
| 47-947 | 11/1972 | Japan . | |
| 48-79101 | 9/1973 | Japan . | |
| 50-103103 | 8/1975 | Japan . | |
| 53-30105 | 3/1978 | Japan . | |
| 56-150235 | 11/1981 | Japan . | |
| 59-20443 | 6/1984 | Japan . | |
| 60-42123 | 12/1985 | Japan . | |
| 61-2200 | 1/1986 | Japan . | |
| 62-103860 | 2/1987 | Japan . | |

*Primary Examiner*—Michael S. Huppert
*Assistant Examiner*—Donald W. Underwood
*Attorney, Agent, or Firm*—Ronald P. Kananen

[57] ABSTRACT

A working machine equipped with a boom, an arm and a bucket and is mounted on a construction vehicle, the working machine being capable of being folded compactly at rest. The working machine is easily brought into an operating position without any special apparatus. The boom is divided into two portions that allow it to be folded compactly. The two boom portions are pivotally attached to each other and the first of the two boom portions is pivotally attached to the chassis of the machine. The boom portions work in cooperation with at least one hydraulic cylinder to move between operative and inoperative positions. A retaining device, which can be in the form of another hydraulic cylinder or pins, is used to hold the boom portions in position with respect to each other.

3 Claims, 9 Drawing Sheets

WORKING MACHINE FOR CONSTRUCTION VEHICLES AND METHOD OF OPERATING THE SAME

This application is a continuation of application Ser. No. 07/476,447 filed Jul. 11, 1990, now abandoned.

TECHNICAL FIELD OF THE INVENTION

The present invention relates to a working machine which comprises a boom, an arm and a bucket and which is mounted on a construction vehicle, for example, a power shovel, and to a method of operating the same. More particularly, the present invention relates to a working machine which is capable of being folded compactly when it is at rest and being changed into an operational position easily when it is to be operated, without requiring any special apparatus.

BACKGROUND ART OF THE INVENTION

One example of the prior art of this type of working machine is disclosed in Japanese Patent Laid-Open (KOKAI) No. 56-150235.

The conventional working machine is, as shown in FIGS. 1 and 2, arranged such that the proximal end portion of a first boom cylinder 3 is pivotably supported on a bell crank 4 that is pivotably supported on a chassis 1 through a bracket 2, and the bell crank 4 is driven by a bell crank cylinder 5, thereby folding the working machine in a compact form. In other words, in order to pivot the proximal end portion of the first boom cylinder 3 in such a manner that no dead point will occur in the link mechanism, it is necessary to provide not only the bell crank 4 and the bell crank cylinder 5 but also a hydraulic circuit means, including a valve and other elements, for controlling the bell crank cylinder 5. Accordingly, the number of parts increases and the structure becomes complicated, and the production cost also rises. In addition, the operation of the working machine also becomes complicated, and a failure is likely to occur. Thus, the prior art involves various problems.

It should be noted that the above-mentioned dead point is a position of the link mechanism in which the pivot point at which the first boom member and the distal end portion of the first boom cylinder are connected pivotably to each other, the pivot point at which the proximal end portion of the first boom member is pivotably attached to the chassis and the pivot point at which the proximal end portion of the first boom cylinder is pivotably attached to the chassis align with each other in a straight line during a pivoting motion of the first boom cylinder. When this position occurs, no hydraulic pressure from the first boom cylinder acts to the outside. In other words, the first boom cylinder cannot function as a driving member. In this application, the term "dead point" is used in the sense of the above.

SUMMARY OF THE INVENTION

In view of the above-described circumstances, it is a first object of the present invention to provide a working machine for construction vehicles which has a relatively simple arrangement with a reduced number of parts, in which the dead point in the link mechanism including the first boom cylinder is positively utilized to pivot the proximal end portion of the first boom cylinder without providing a bell crank, a bell crank cylinder and a hydraulic circuit means for controlling the bell crank cylinder, thereby lowering the production cost and making the working machine unlikely to have a failure.

It is another object of the present invention to provide a method of operating a working machine, wherein the operation is remarkably simplified by positively utilizing the dead point in the link mechanism including the first boom cylinder.

To attain the first object, according to a first mode of the present invention, there is provided a working machine for construction vehicles having a boom that is divided into first and second boom members, which are connected to a chassis in the mentioned order, an arm that is pivotably connected to the distal end portion of the second boom member, one arm cylinder that is pivotably connected between the proximal end of the arm and a predetermined position of the second boom member, a bucket that is pivotably attached to the distal end of the arm, a bucket cylinder that is pivotably connected between the proximal end of the bucket and a predetermined position of the arm, and a bucket retainer that is provided on the forward end portion of the chassis, wherein the improvement comprises: the first boom member which is vertically pivotably supported at one side of the proximal end thereof on a predetermined position of the chassis through a bracket, the first boom member being pivotably connected at the distal end thereof to one side of the proximal end of the second boom member so that the second boom member is pivotable vertically; a first boom cylinder which is pivotably supported at the proximal end thereof on another predetermined position of the chassis through another bracket, and at the distal end thereof on the distal end of the first boom member, to pivot the first boom member vertically; and a retainer means which is connected between the first and second boom members for maintaining the second boom member in a raised position with respect to the first boom member.

According to a second mode of the present invention, there is provided a working machine according to the first mode, wherein the retainer means is a second boom cylinder which is pivotably connected between the respective other sides of the proximal end portions of the first and second boom members.

According to a third mode of the present invention, there is provided a working machine according to the first mode, wherein the retainer means is a second boom cylinder which is pivotably connected between the respective other sides of the proximal end portions of the first and second boom members, and the first boom cylinder has a dead point which is rearward of a position where the first boom cylinder assumes an operational position so that when the first boom cylinder reaches the dead point, the center of gravity of the working machine is at a position which is closer to the forward end of the chassis than the pivot point at which the first side of the proximal end portion of the first boom member is pivotably attached to the chassis.

According to a fourth mode of the present invention, there is provided a working machine according to the first mode, wherein the retainer means is one or a plurality of pin members which are inserted into a pin bore that is formed in the other side of the distal end portion of the first boom member and a pin bore that is formed in the other side of the proximal end portion of the second boom member, when these two pin bores are aligned with each other.

To attain the second object of the present invention, according to a fifth mode of the present invention, there is provided a method of operating the working machine according to the third mode, wherein the first boom cylinder is caused to move beyond the dead point by making use of the hydraulic pressure from each of the cylinders, and gravitational force and inertia force, which act on the working machine.

To attain the second object, according to a sixth mode of the present invention, there is provided a method of operating the working machine according to the third or fourth mode, wherein the first boom cylinder is caused to move beyond the dead point by making use of the hydraulic pressure from each of the cylinders, gravitational force and inertia force, which act on the working machine, and counterforce from the bucket retainer.

According to a seventh mode of the present invention, there is provided a method of operating the working machine according to the fifth mode, which comprises the steps of: contracting the second boom cylinder to raise the second boom member; expanding, after the second boom member has been raised, the first boom cylinder to raise the first boom member; bringing, after the first boom cylinder has reached the vicinity of the dead point, the first boom cylinder into a floating state and contracting the first boom cylinder, thus enabling the working machine to be brought to an operational position by pivoting force that is caused by gravity and hydraulic pressure from the first boom cylinder and maintained in the operational position by the operation of the second boom cylinder; expanding, after completion of work, the first boom cylinder and, at the same time, contracting the second boom cylinder to move the first boom member to near the dead point of the first boom cylinder; bringing, after the first boom cylinder has reached the vicinity of the dead point, the first boom cylinder into a floating state or contracting the same so that the first boom member is moved toward the rear end of the chassis beyond the dead point of the first boom cylinder by the gravitational force and inertia force, which act on the working machine, and the working machine is held at a predetermined rearward position of the chassis by the first boom cylinder; and contracting the first boom cylinder and, at the same time, expanding the second boom cylinder, to fold the first and second boom members.

According to an eighth mode of the present invention, there is provided a method of operating the working machine according to the sixth mode, which comprises the steps of: bringing the second boom cylinder into a floating state and expanding the first boom cylinder to raise the first boom member to near the dead point of the first boom cylinder; expanding and contracting, after the first boom cylinder has reached the vicinity of the dead point, the bucket cylinder to ensure the retaining of the bucket by the bucket retainer and, at the same time, expanding the arm cylinder with the first and second boom cylinders being brought into a floating state; further raising the first boom cylinder beyond the dead point by making use of the counterforce from the bucket retainer, hydraulic pressures from the bucket cylinder and the arm cylinder, or gravitational force and inertia force, which act on the working machine, thereby bringing the working machine to an operational position; expanding and contracting, after completion of work, the bucket cylinder to retain the bucket on the bucket retainer, and expanding the first boom cylinder and contracting the arm cylinder, with the second boom cylinder being brought into a floating state, to move the first boom member to near the dead point of the first boom cylinder; and gradually bringing, after the first boom member has passed the dead point of the first boom cylinder by the gravitational or inertia force acting on the working machine, the first and second boom cylinders into a floating state, or contracting the first boom cylinder and expanding the second boom cylinder, to fold the first and second boom members by making use of the gravity of the working machine.

According to a ninth mode of the present invention, there is provided a method of operating the working machine according to the sixth mode, which comprises the steps of: expanding the first boom cylinder to raise the first boom member to near the dead point of the first boom cylinder; expanding and contracting, after the first boom cylinder has reached the vicinity of the dead point, the bucket cylinder to ensure the retaining of the bucket by the bucket retainer, and bringing the first boom cylinder into a floating state and, at the same time, expanding the arm cylinder; further raising the first boom cylinder beyond the dead point and tilting the first boom member toward the forward end of the chassis by making use of the counterforce from the bucket retainer, hydraulic pressures from the cylinders, or gravitational force and inertia force, which act on the working machine; expanding and contracting the arm cylinder to align a pin bore that is formed in the other side of the distal end portion of the first boom member and a pin bore that is formed in the other side of the proximal end portion of the second boom member; inserting, after the two pin bores have been aligned with each other, one or a plurality of fixing pins into the pin bores to maintain an operational position of the working machine; actuating, after completion of work, all the cylinders to retain the bucket on the bucket retainer finely expanding and contracting, after the bucket has been retained, the first boom cylinder to remove the fixing pins; expanding, after the fixing pins have been removed, the first boom cylinder and the bucket cylinder while retaining the bucket on the bucket retainer by expanding the arm cylinder, to move the first boom member to near the dead point of the first boom cylinder; and gradually bringing, after the first boom member has passed the dead point of the first boom cylinder by the graviational or inertia force acting on the working machine, the first boom cylinder into a floating state to fold the first and second boom members by making use of the gravity of the working machine.

It should be noted that the above-described "floating state" of a cylinder is a state wherein no hydraulic pressure acts on the cylinder, which occurs when each of the ports at the rod and bottom sides of the cylinder is communicated with a tank, for example. In the present application, this term is used in the sense of the above in the following description.

The above and other objects, modes and advantages of the present invention will become apparent to those skilled in the art from the following description of preferred embodiments which are conformable to the principle of the present invention, taken in conjunction with the accompanying drawings.

DETAILED DESCRIPTIONS OF PREFERRED EMBODIMENTS

The present invention will be described below in more detail in conjunction with FIGS. 3 to 14 in the accompanying drawings.

Figure 1:
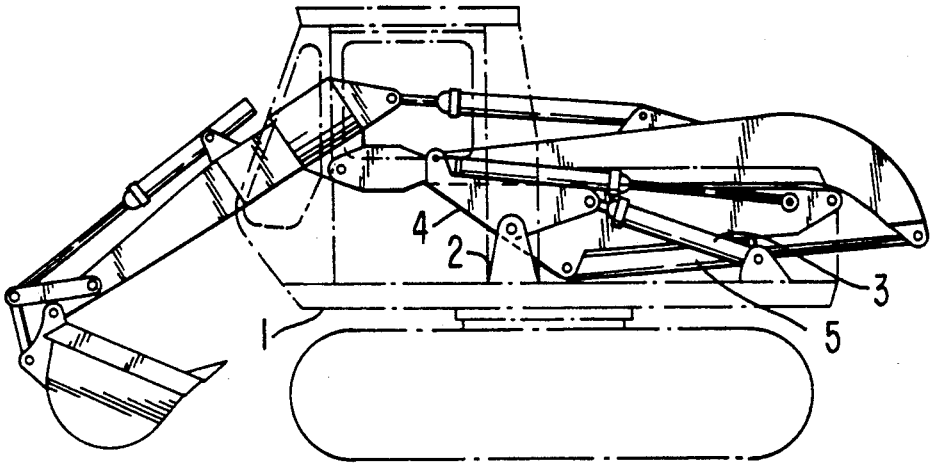
FIG. 1 PRIOR ART
FIGS. 1 and 2 show a prior art, FIG. 1 being a schematic side view of a power shovel which is equipped with a conventional working machine, and FIG. 2 being a view that is employed to explain an operation of the conventional working machine that is shown in FIG. 1.
Figure 2:
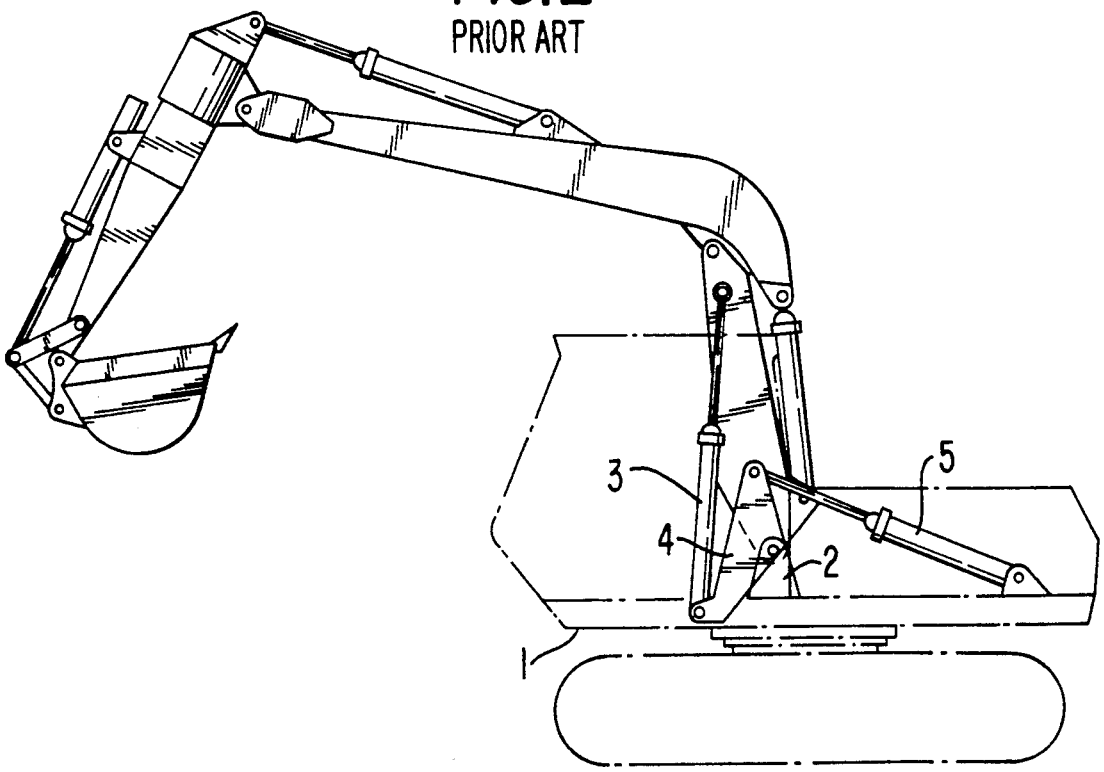
FIG. 2 PRIOR ART
Figure 3:
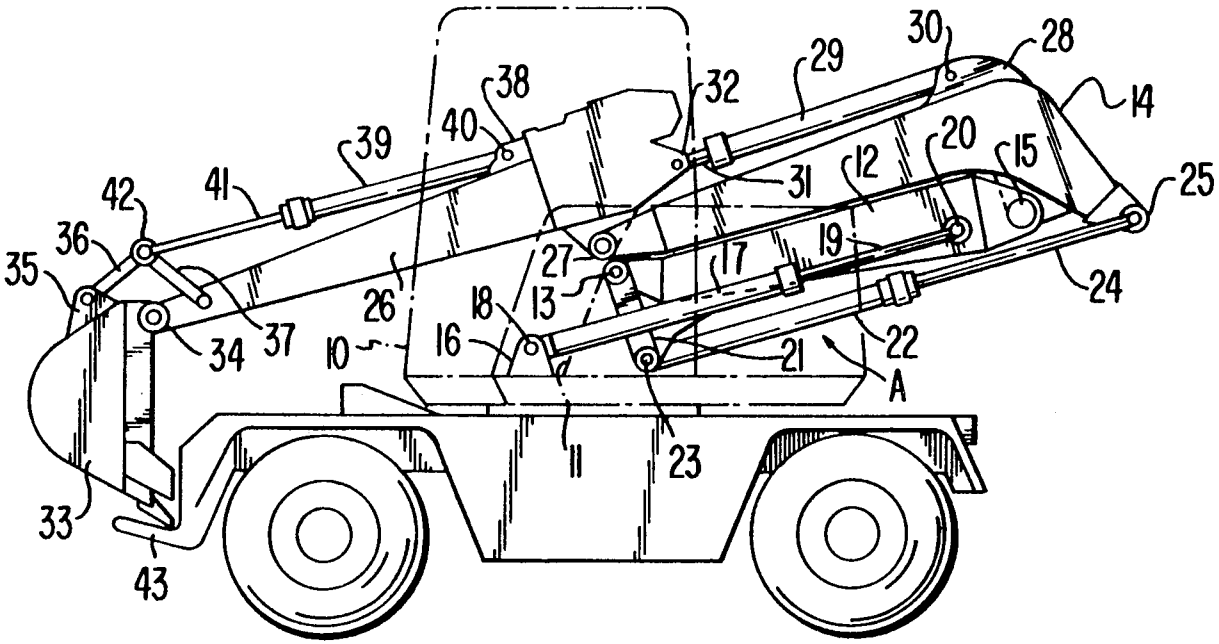
FIG. 3 is a schematic side view of a construction vehicle which is equipped with a working machine as being a first embodiment of the present invention.

In FIG. 3, which shows a first embodiment of the present invention, reference numeral 10 denotes a chassis, which is provided with a mounting bracket 11. The proximal end portion of a first boom member 12 is vertically pivotably attached to the mounting bracket 11 throuth a pin member 13. The proximal portion of a second boom member 14 is attached vertically pivotably to the distal end portion of the first boom member 12 through a pin member 15. To the chassis 10 are secured brackets 16 which are located at the left and right sides, respectively, of the first boom member 12. The proximal end portion of a first boom cylinder 17 is connected to these brackets 16 through a pin member 18, and a piston rod 19 of the first boom cylinder 17 is connected to the upper portion of the first boom member 12 through a pin member 20.

A bracket 21 is provided at the rear side of the proximal portion of the first boom member 12. The proximal end portion of a second boom cylinder 22, which serves as a retainer means "A" for the second boom member 14, is connected to the bracket 21 through a pin member 23, and a piston rod 24 of the second boom cylinder 22 is connected to the proximal end portion of the second boom member 14 through a pin member 25.

An arm 26 is vertically pivotably attached at the lower side of its proximal portion to the distal end portion of the second boom member 14 through a pin member 27. A bracket 28 is provided on the proximal portion of the second boom member 14. The proximal end portion of an arm cylinder 29 is connected to the bracket 28 through a pin member 30, and a piston rod 31 of the arm cylinder 29 is connected to the proximal end portion of the arm 26 through a pin member 32.

A bucket 33 is pivotably attached to the distal end portion of the arm 26 through a pin member 34. One end portion of a link 36 is connected to a rear bracket 35 of the bucket 33, and one end portion of a link 37 is connected to the distal end portion of the arm 26. A bracket 38 is provided on the proximal portion of the arm 26. The proximal end portion of a bucket cylinder 39 is connected to the bracket 38 through a pin member 40, and a piston rod 41 of the bucket cylinder 39 is connected to the joint of the other end portions of the links 36 and 37 through a pin member 42.

It should be noted that an element which is denoted by reference numeral 43 at the lower side of the forward end portion of the chassis is a bucket retainer for retaining the bucket 33 when the working machine is folded.

Figure 4:
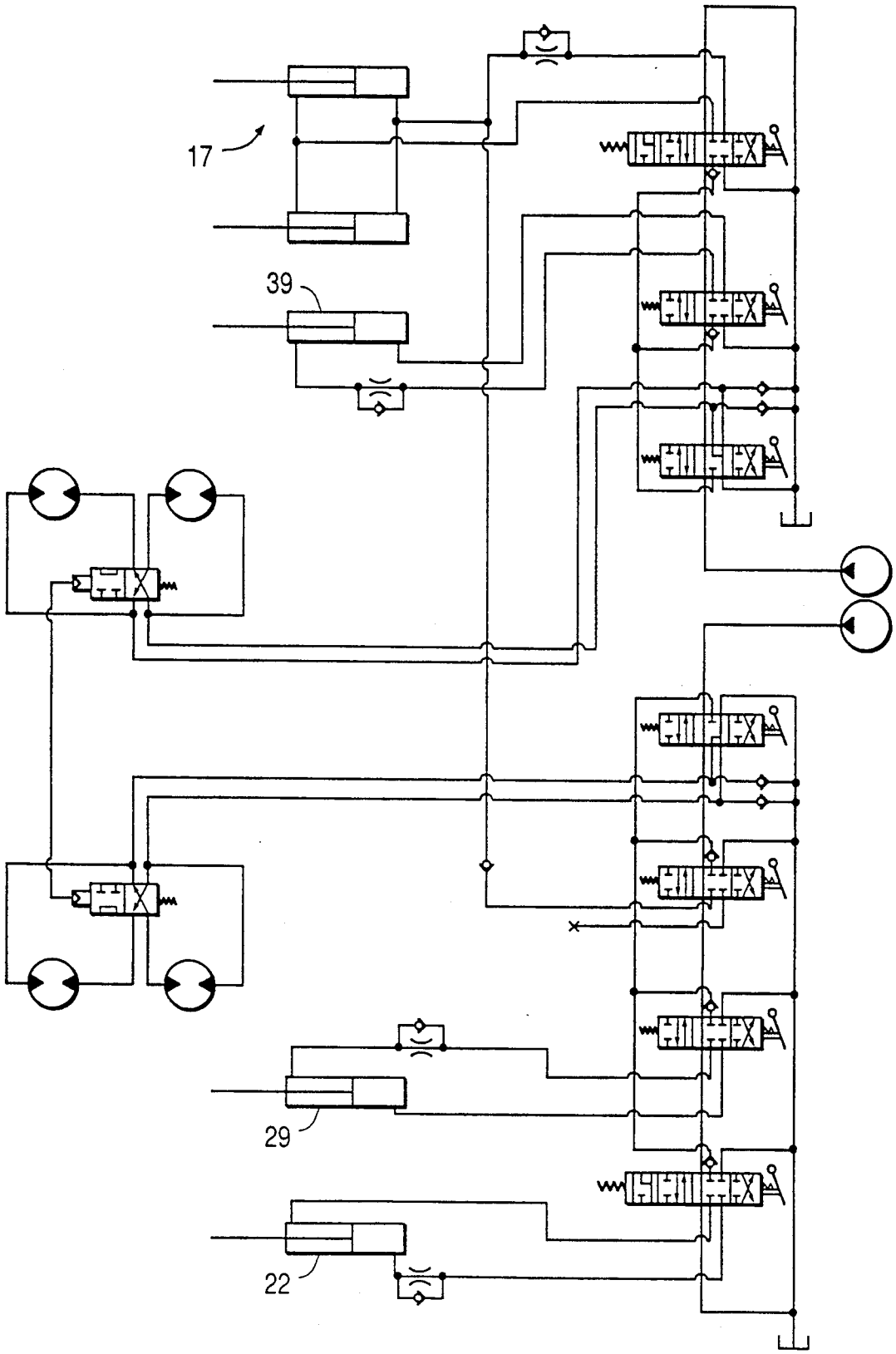
FIG. 4 is a diagram showing a hydraulic control circuit which relates to hydraulic cylinders for driving the working machine according to the present invention.

FIG. 4 shows a hydraulic control circuit which relates to the hydraulic cylinders for driving the working machine of the present invention. Since this hydraulic control circuit is the same as the one which has heretofore generally been employed to operate this type of working machine, detailed description thereof is omitted.

An operation of the working machine that is shown in FIG. 3 will next be explained in conjunction with FIG. 3 and FIGS. 5 to 8, which illustrate in combination an operation of the working machine.

FIG. 3 is a side view of the working machine that is folded compactly in such a condition that the first boom cylinder 17 is pivoted to a position below the pivot point 13 at which the proximal end portion of the first boom member 12 is pivotably attached to the chassis 10, and with the second boom cylinder 22 being expanded and the arm cylinder 29 being contracted so that the second boom member 14 and the arm 26 are substantially parallel to each other, the bucket 33 is retained by the bucket retainer 43 on the chassis 10 by the operation of a bucket actuating apparatus.

Figure 5:
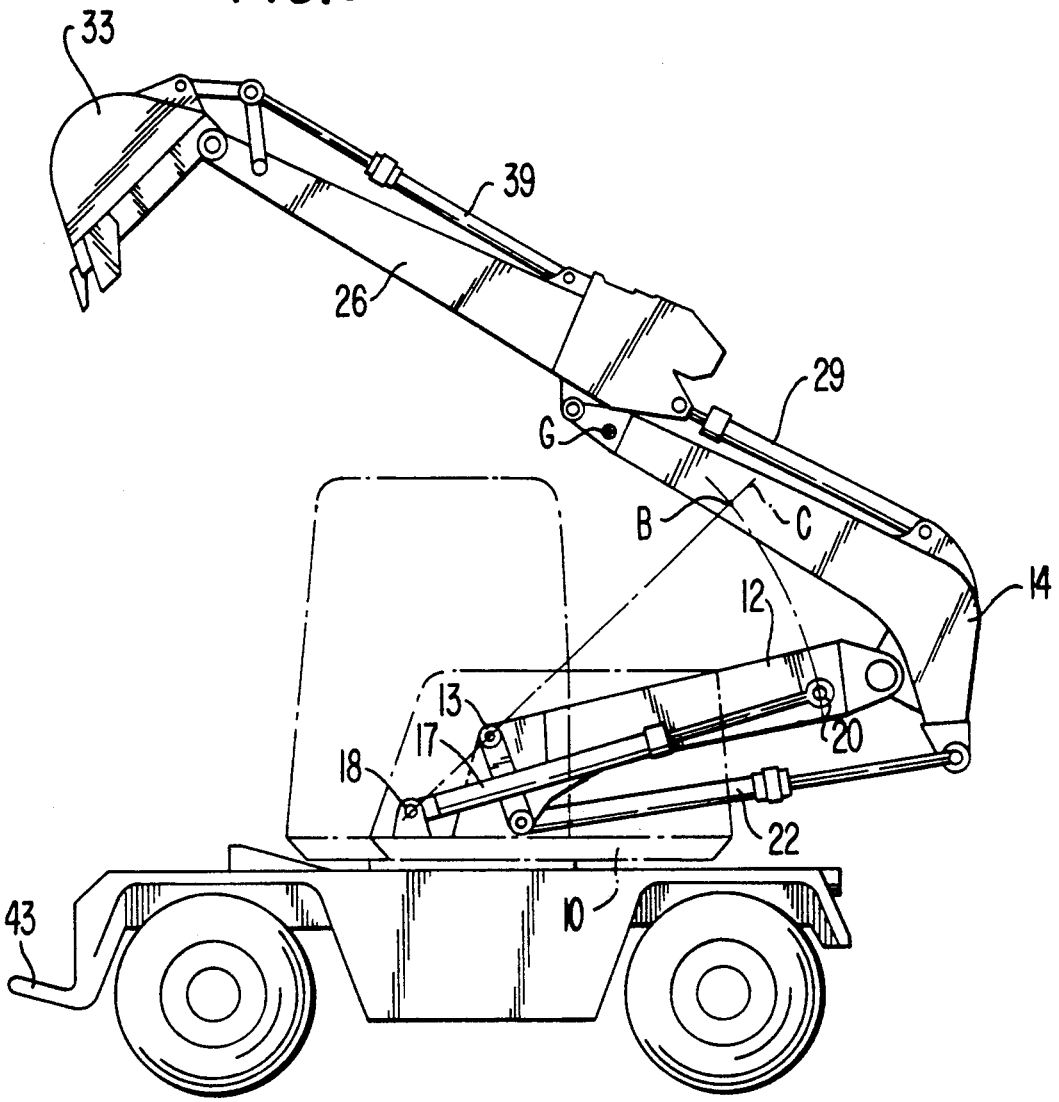
FIGS. 5 to 8 are views which are employed to explain an operation of the working machine that is shown in FIG. 3.

When the working machine that is in a folded position such as that shown in FIG. 3 is to be unfolded into an operational position, the second boom cylinder 22 is contracted to raise each of the elements of the working machine which are closer to the distal end of the machine than the second boom member 14, as shown in FIG. 5.

Subsequently, the first boom cylinder 17 is expanded. In consequence, the first boom member 12 rises in such a manner as to pivot upwardly, and the center of gravity G of the working machine also moves forwardly. However, since the ratio of the pivoting force applied to the first boom member 12 to the thrust from the first boom cylinder 17 decreases, the hydraulic pressure in the first boom cylinder 12 rises to reach a set relief pressure, so that the pivoting of the first boom member 12 is suspended. At this time, however, the second boom cylinder 22 is actuated so that the center of gravity G of the working machine moves to a position which is forward of the pivot point 13 at which the proximal end portion of the first boom member 12 is pivotably attached to the chassis 10.

It should be noted that, if the center of gravity G of the working machine has already moved to a position which is forward of the pivot point 13 before the hydraulic pressure in the first boom cylinder 17 reaches the set relief pressure, the second boom cylinder 22 need not be actuated.

It is also possible to move the center of gravity G of the working machine to a position which is forward of the pivot point 13 by making use of the inertia force acting on the working machine while the pivoting force applied to the first boom member 12 is sufficiently large relative to the thrust from the first boom cylinder 17.

Figure 6:
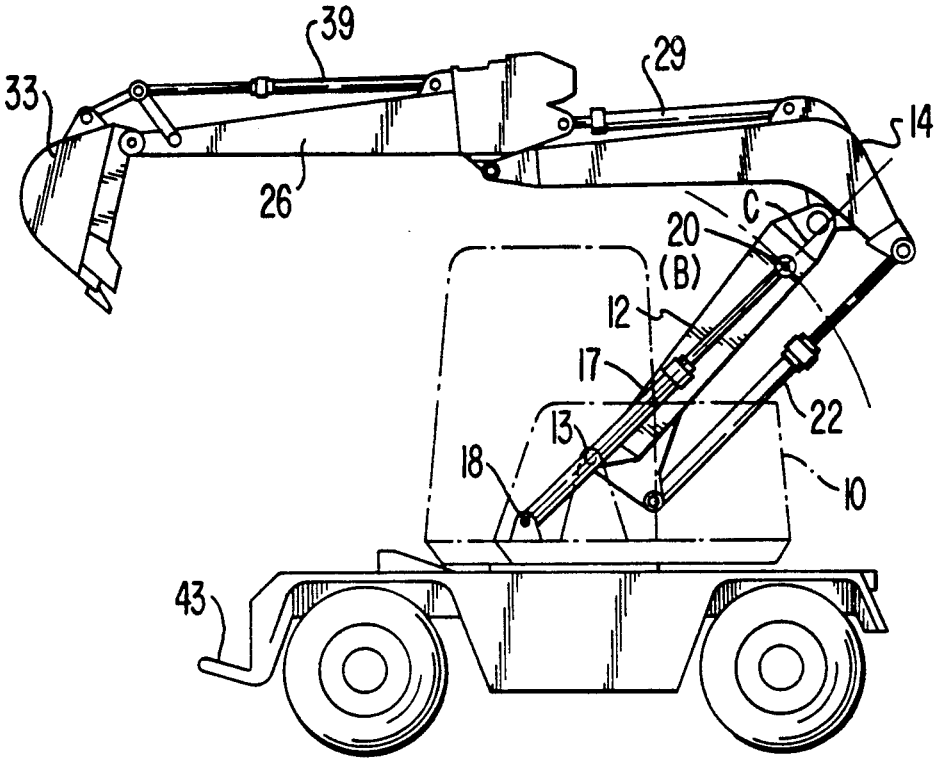
Figure 7:
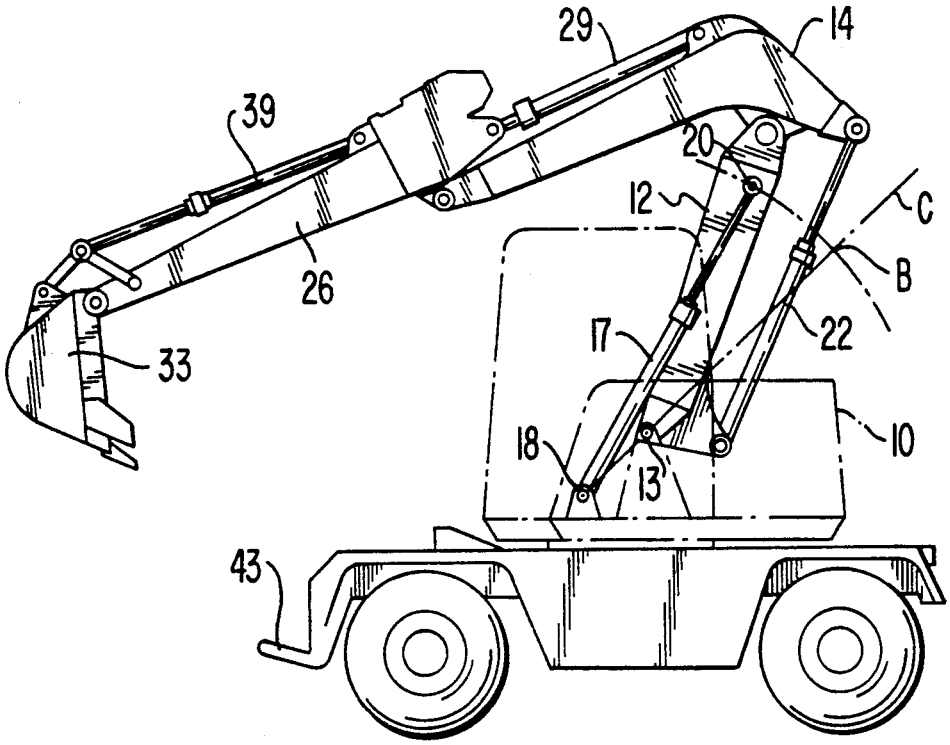

If, in the above-described state, the first boom cylinder 17 is brought into a floating state, the working machine further pivots forwardly by gravity, as shown in FIG. 6, and consequently the first boom cylinder 17 passes the pivot point 13. Thereafter, the working machine assumes an operational position, as shown in FIG. 7, so that it is possible to perform work by an operation which is similar to that in the prior art.

The following is a description of an operation that is conducted to fold the working machine which is in an operational position. If the first boom cylinder 17 is expanded and the second boom cylinder 22 is contracted when the working machine is in the operational position that is shown in FIG. 7, the section of the working machine that is closer to the distal end than the second boom member 14 rises, and the first boom member 12 pivots rearwardly, so that the center of gravity G of the working machine moves rearwardly and its position approaches that shown in FIG. 6.

Figure 8:
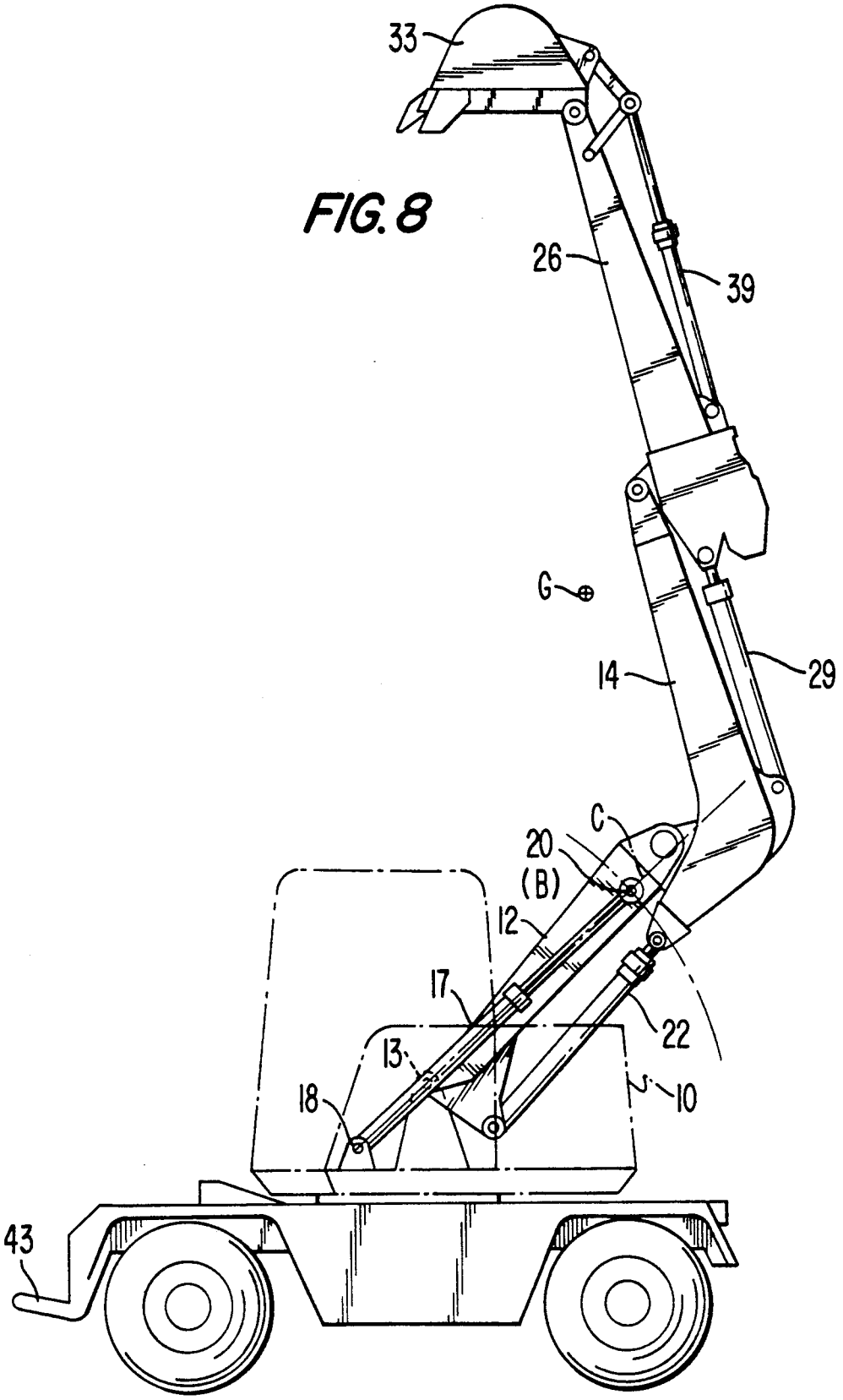

However, as the first boom cylinder 17 comes closer to the pivot point 13, the ratio of the pivoting force applied to the first boom member to the thrust from the first boom cylinder 17 decreases. Accordingly, the hydraulic pressure in the first boom cylinder rapidly rises to reach the set relief pressure, thus causing the pivoting of the first boom member 12 to be suspended. At this time, however, the second boom cylinder 22 is contracted so that the center of gravity G of the working machine moves to a position which is rearward of the pivot point 13, as shown in FIG. 8.

It should be noted that, if the center of gravity G of the working machine has already moved to a position which is rearward of the pivot point 13 before the hydraulic pressure in the first boom cylinder 17 reaches the set relief pressure, the second boom cylinder 22 need not be contracted.

It is also possible to move the center of gravity G of the working machine to a position which is rearward of the pivot point 13 by making use of the inertia force acting on the working machine while the pivoting force applied to the first boom member 14 is sufficiently large relative to the thrust from the first boom cylinder 17.

If, in the above-described state, the first boom cylinder 17 is brought into a floating state, the working machine pivots rearwardly by gravity and consequently the first boom cylinder 17 passes the pivot point 13, resulting in the working machine assuming a position such as that shown in FIG. 5.

Thereafter, the working machine can be brought into the folded position that is shown in FIG. 3 by the operation that has been described at the beginning of this embodiment.

Figure 9:
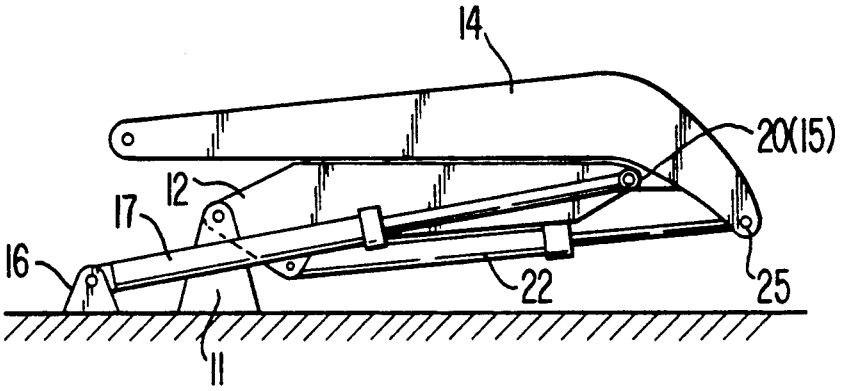
FIG. 9 is a fragmentary schematic view of a working machine as being a second embodiment of the present invention.

FIG. 9 shows a second embodiment of the present invention. In this embodiment, the point 20 at which the piston rod 19 of the first boom cylinder 17 is pivotably attached to the first boom member 12 is on the pin member 15 that connects together the first boom member 12 and the second boom member 14. The other arrangements and operation of this embodiment are the same as those of the first embodiment of the present invention, and the method of operating the second embodiment is also the same as that for the first embodiment. Detailed description thereof is therefore omitted.

Figure 10:
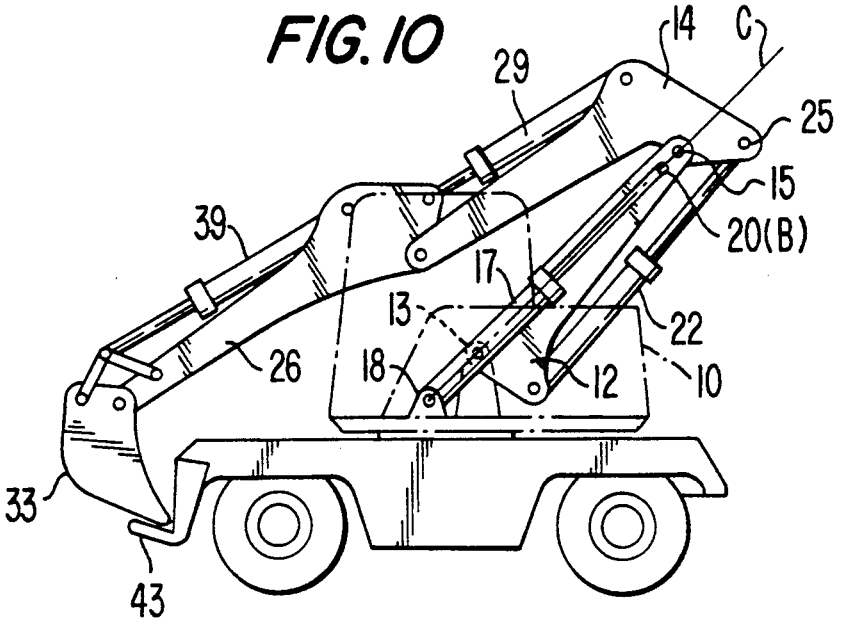
FIGS. 10 and 11 are views which are employed to explain another operation of the working machine that is shown in FIG. 3.
Figure 11:
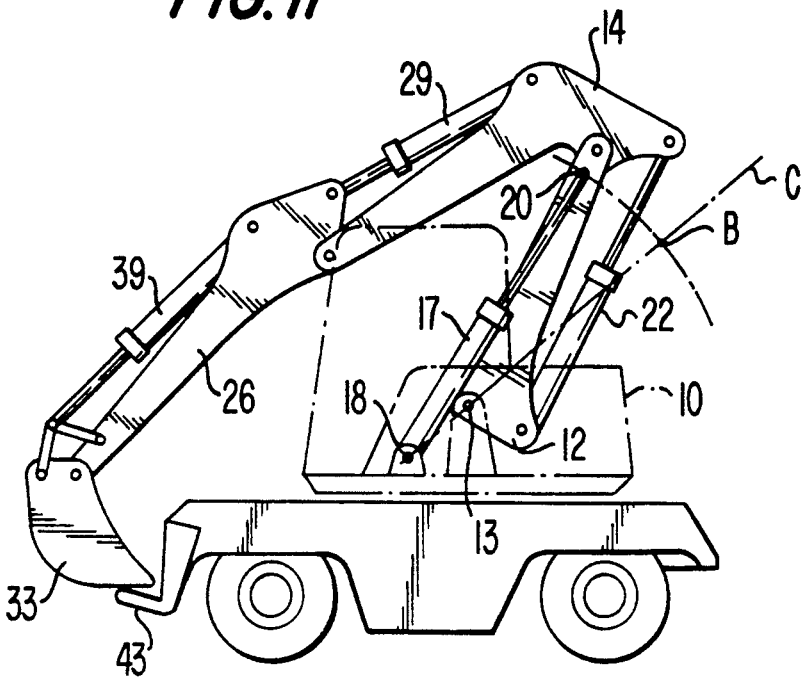

FIGS. 10 and 11 are views which are employed to explain another method of operating the above-described first embodiment.

In the second operating method, when the working machine is changed from a folded position to an operational position, or vice versa, counterforce from the bucket retainer 43 is also utilized in addition to the hydraulic pressure from each cylinder and the inertia force resulting from the gravity that acts on the working machine, while ensuring the retaining of the bucket by the bucket retainer 43.

As has been described above, the first boom cylinder 17 in the present invention has "dead point in the link mechanism", which will be explained below. That is, the pivot point 20 at which the first boom member 12 and the distal end portion of the first boom cylinder 17 are connected pivotably to each other, the pivot point 13 at which one side of the proximal end portion of the first boom member 12 is pivotably attached to the chassis 10 and the pivot point 18 at which the proximal end portion of the first boom cylinder 17 is pivotably attached to the chassis 10 align with each other in a straight line C during a pivoting motion of the first boom cylinder 17. The position B on the straight line C of the pivot point 20 at which the distal end portion of the first boom cylinder 17 is pivotally attached is called the dead point of the first boom cylinder 17.

It should be noted that the border line beyond which the center of gravity G of the working machine moves forwardly of the chassis 10 to a position which is forward of the pivot point 13, at which the proximal end portion of the first boom member 12 is pivotally attached to the chassis 10, in the above-described first operating method of the first embodiment is, needless to say, equivalent to the dead point B.

The operating method that is shown in FIGS. 10 and 11 is as follows:

(1) From the folded position to near the dead point B:

With the second boom cylinder 22 being brought into a floating state, the first boom cylinder 17 is expanded to raise the first boom member 12 to near the dead point B of the first boom cylinder 17.

(2) From near the dead point B to an operational position:

The distal end portion of the bucket 33 is retained on the bucket retainer 43 by expanding and contracting the bucket cylinder 39, and at the same time as the first and second boom cylinders 17 and 22 are brought into a floating state, the arm cylinder 29 is expanded to cause the first boom member to further rise beyond the dead point. Thus, the working machine assumes an operational position.

(3) From the operational position to near the dead point B:

The distal end portion of the bucket 33 is retained on the bucket retainer 43 by expanding and contracting the bucket cylinder 39, and with the second boom cylinder 22 being brought into a floating state, the first boom cylinder 17 is expanded and, at the same time, the arm cylinder 29 is contracted to lower the first boom member 12 to near the dead point.

(4) From near the dead point B to the folded position:

After the first boom member 12 has lowered to near the dead point B, all the cylinders are gradually brought into a floating state, or the second boom cylinder 22 is brought into a floating state and the first boom cylinder 17 is contracted, thereby enabling the working machine to return to the folded position by gravity or by a combination of the gravity and the hydraulic pressure from the first boom cylinder 17.

Figure 12:
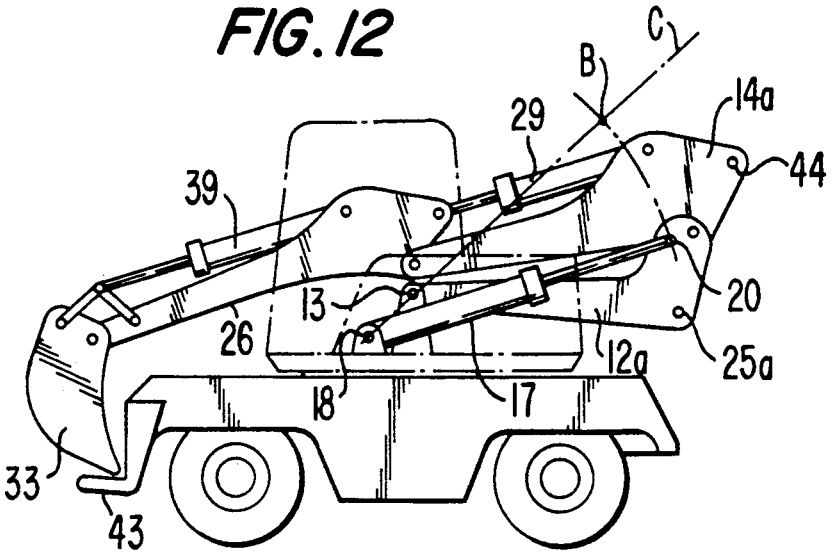
FIG. 12 is a schematic side view of a construction vehicle which is equipped with a working machine as being a third embodiment of the present invention.

A third embodiment of the working machine according to the present invention is shown in FIG. 12. Unlike the first and second embodiments in which the second boom cylinder 22 is employed as a position retaining means A for the second boom member 14, the third embodiment employs as a position retaining means A for the second boom member 14 one or a plurality of fixing pins 45 which are inserted into a pin bore 25*a* that is bored in the other side of the distal end portion of the first boom member 12 and a pin bore 44 that is bored in the other side of the proximal end portion of the second boom member 14*a*, when these pin bores 25*a* and 44 align with each other.

Figure 13:
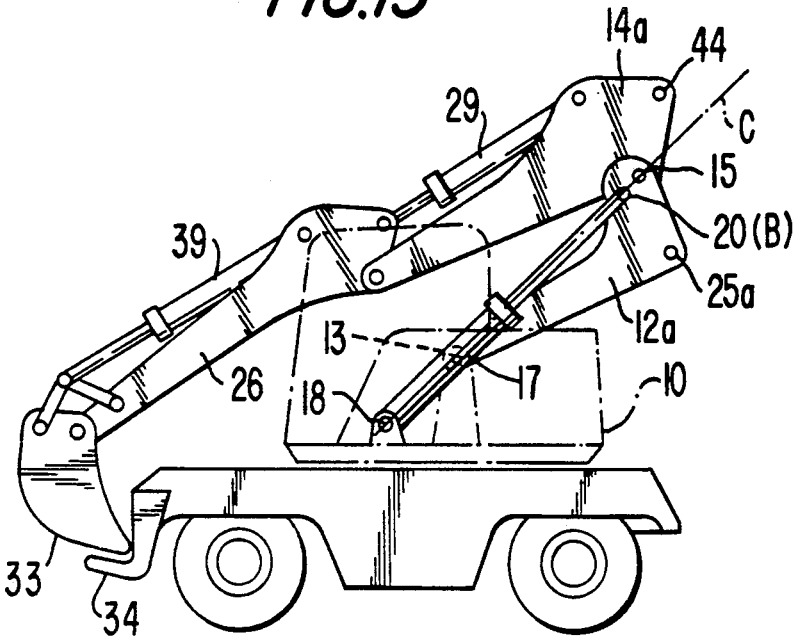
FIGS. 13 and 14 are views which are employed to explain an operation of the working machine that is shown in FIG. 12.
Figure 14:
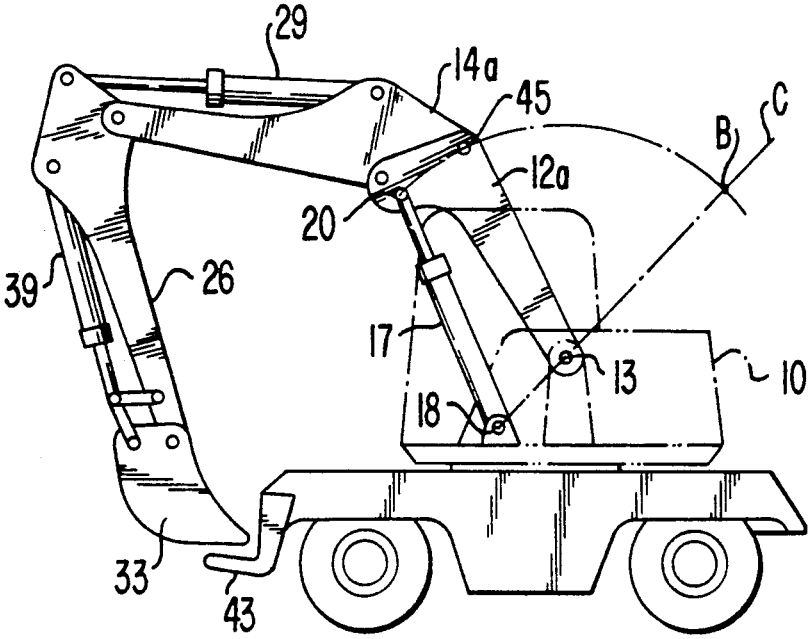

A method of operating the third embodiment will be explained below in conjunction with FIGS. 12 to 14.

(1) From the folded position to near the dead point B: The first boom cylinder 17 is expanded to raise the first boom member 12 to near the dead point.

(2) From the dead point B to an operational position: The bucket cylinder 39 is expanded and contracted to retain the distal end portion of the bucket 33 on the bucket retainer 43, and while doing so, the first boom cylinder 17 is brought into a floating state and, at the same time, the arm cylinder 29 is expanded to cause the first boom member 12 to further rise beyond the dead point B.

(3) Retaining of the position of the second boom member 14:

The pin bore 25*a* that is bored in the second side of the distal end portion of the first boom member 12 and the pin bore 44 that is provided in the second side of the proximal end portion of the second boom member 14 are aligned with each other by finely actuating the first boom cylinder 17, and the fixing pin(s) 45 is inserted into the two pin bores aligned with each other by a manual operation. Thus, the position of the second boom member 14 is maintained by the first boom member 12 that is held by the first boom cylinder 17.

(4) Cancellation of the retaining of the position of the second boom member 14:

After the distal end portion of the bucket 33 has been retained on the bucket retainer 43 by expanding and contracting all the hydraulic cylinders, the fixing pin(2) 45 is loosened by finely actuating the first boom cylinder 17 and then removed by a manual operation. Thus, the first boom member 17 and the second boom member 14 become pivotable relative to each other.

(5) From the operational position to near the dead point B:

The first boom cylinder 17 and the bucket cylinder 39 are expanded and the arm cylinder 29 is also expanded to retain the distal end portion of the bucket 33 on the bucket retainer 43 and pivot the first boom member 12 to near the dead point B.

(6) From near the dead point B to the folded position: After the first boom member 12 has pivoted (lowered) to near the dead point B, all the cylinders are gradually brought into a floating state, or the first boom cylinder 17 is contracted, thereby enabling the working machine to return to the folded position by gravity or a combination of the gravity and the hydraulic pressure from the first boom cylinder.

The foregoing description is only illustrative of preferred embodiments of the present invention, and the scope of the present invention is not limitative thereto. Numeous changes and modifications could readily be conceived by those skilled in the art without departing from the scope of the present invention.

What is claimed is:

1. In a working machine for construction vehicles having a boom that is divided into first and second boom members, which are connected to a chassis in the mentioned order, an arm that is pivotably connected to the distal end portion of said second boom member, one arm cylinder that is pivotably connected between the proximal end of said arm and a predetermined position on said boom member, a bucket that is pivotably attached to the distal end of said arm, a bucket cylinder that is pivotably connected between the proximal end of said bucket and a predetermined position on said arm, and a bucket retainer that is provided on the forward end portion of said chassis, wherein said first boom member is vertically pivotably supported at one side of the proximal end thereof at a predetermined position on said chassis through a bracket, said first boom member being pivotably connected at the distal end thereof to one side of the proximal end of said second boom member so that said second boom member is pivotable vertically; a first boom cylinder which is pivotably supported at the proximal end thereof on another predetermined position on said chassis through another bracket, and at the distal end thereof on the distal end of said first boom member, to pivot said first boom member vertically; and a retainer means which is connected between said first and second boom members for maintaining said second boom member in a raised position with respect to said first boom member;

and wherein said retainer means is a second boom cylinder which is pivotably connected between the respective other sides of the proximal end portions of said first and second boom members, and said first boom cylinder has a dead point which is rearward of a position where said first boom cylinder assumes an operational position so that when said first boom cylinder reaches the dead point, the center of gravity of said working machine is at a position which is closer to the forward end of said chassis than the pivot point at which the first side of the proximal end portion of said first boom member is pivotably attached to said chassis;

a method of unfolding and folding said boom of said working machine wherein said first cylinder is moved beyond the dead point by using the hydraulic pressure from each of said cylinders, and gravitational force and inertia force, which act on said working machine, said method comprising the steps of: contracting said second boom cylinder to raise said second boom member; expanding, after said second boom member has been raised, said first boom cylinder to raise said first boom member; bringing, after said first boom cylinder has reached the vicinity of the dead point, said first boom cylinder into a floating state and contracting said first boom cylinder, thus enabling said working machine to be brought to an operational position by pivoting force that is caused by gravity and hydraulic pressure from said first boom cylinder and maintained in the operational position by the operation of said second boom cylinder; expanding, after completion of work, said first boom cylinder and, at the same time, contracting said second boom cylinder to move said first boom member to near the dead point of said first boom cylinder; bringing, after said first boom cylinder has reached the vicinity of the dead point, said first boom cylinder into a floating state so that said first boom member is moved toward the rear end of said chassis beyond the dead point of said first boom cylinder by the gravitational force and inertia force, which act on said working machine, and said working machine is held at a predetermined rearward position of said chassis by said first boom cylinder; and contracting said first boom cylinder and, at the same time, expanding said second boom cylinder, to fold said first and second boom members.

2. In a working machine for construction vehicles having a boom that is divided into first and second boom members, which are connected to a chassis in the mentioned order, an arm that is pivotably connected to the distal end portion of said second boom member, one arm cylinder that is pivotably connected between the proximal end of said arm and a predetermined position on said second boom member, a bucket that is pivotably attached to the distal end of said arm, a bucket cylinder that is pivotably connected between the proximal end of said bucket and a predetermined position on said arm, and a bucket retainer that is provided on the forward end portion of said chassis, wherein said first boom member is vertically pivotably supported at one side of the proximal end thereof at a predetermined position on said chassis through a bracket, said first boom member being pivotably connected at the distal end thereof to one side of the proximal end of said second boom member so that said second boom member is pivotable vertically; a first boom cylinder which is pivotably supported at the proximal end thereof on another predetermined position on said chassis through another bracket, and at the distal end thereof on the distal end of said first boom member, to pivot said first boom member vertically; and a retainer means which is connected between said first and second boom members for maintaining said second boom member in a raised position with respect to said first boom member;

and, wherein said retainer means is a second boom cylinder which is pivotably connected between the respective other sides of the proximal end portions of said first and second boom members, and said firs boom cylinder has a dead point which is rearward of a position where said first boom cylinder assumes an operational position so that when said first boom cylinder reaches the dead point, the center of gravity of said working machine is at a position which is closer to the forward end of said chassis than the pivot point at which the first side of the proximal end portion of said first boom member is pivotably attached to said chassis;

a method of unfolding and folding said working machine wherein said first boom cylinder is caused to move beyond the dead point by making use of the hydraulic pressure from each of said cylinders, gravitational force and inertia force, which act on said working machine, and counterforce from said bucket retainer, said method comprising the steps of: bringing said second boom cylinder into a floating state and expanding said first boom cylinder to raise said first boom member to near the dead point of said first boom cylinder; expanding and contracting, after said first boom cylinder has reached the vicinity of the dead point, said bucket cylinder to ensure the retaining of said bucket by said bucket retainer and, at the same time, expanding said arm cylinder with said first and second boom cylinders being brought into a floating state; further raising said first boom cylinder beyond the dead point by making use of the counterforce from said bucket retainer, and hydraulic pressures from said bucket cylinder and said arm cylinder, which act on said working machine, thereby bringing said working machine to an operational position; expanding and contracting, after completion of work, said bucket cylinder to retain said bucket on said bucket retainer, and expanding said first boom cylinder and contracting said arm cylinder, with said second boom cylinder being brought into a floating state, to move said first boom member to near the dead point of said first boom cylinder; and gradually bringing, after said first boom member has passed the dead point of said first boom cylinder by the gravitational or inertia force acting on said working machine, said first and second boom cylinders into a floating state to fold said first and second boom members by making use of the gravity of said working machine.

3. In a working machine for construction vehicles having a boom that is divided into first and second boom members, which are connected to a chassis in the mentioned order, an arm that is pivotably connected to the distal end portion of said second boom member, one arm cylinder that is pivotably connected between the proximal end of said arm and a predetermined position on said second boom member, a bucket that is pivotably attached to the distal end of said arm, a bucket cylinder that is pivotably connected between the proximal end of said bucket and a predetermined position on said arm, and a bucket retainer that is provided on the forward end portion of said chassis, wherein said first boom member is vertically pivotably supported at one side of the proximal end thereof at a predetermined position on said chassis through a bracket, said first boom member being pivotably connected at the distal end thereof to one side of the proximal end of said second boom member so that said second boom member is pivotable vertically; a first boom cylinder which is pivotably supported at the proximal end thereof on another predetermined position on said chassis through another bracket, and at the distal end thereof on the distal end of said first boom member, to pivot said first boom member vertically; and a retainer means which is connected between said first and second boom members for maintaining said second boom member in a raised position with respect to said first boom member;

and, wherein said retainer means is a second boom cylinder which is pivotably connected between the respective other sides of the proximal end portions of said first and second boom members, and said first boom cylinder has a dead point which is rearward of a position where said first boom cylinder assumes an operational position so that when said first boom cylinder reaches the dead point, the center of gravity of said working machine is at a position which is closer to the forward end of said chassis than the pivot point at which the first side of the proximal end portion of said first boom member is pivotably attached to said chassis;

a method of unfolding and folding said working machine wherein said first boom cylinder is caused to move beyond the dead point by making use of the hydraulic pressure from each of said cylinders, gravitational force and inertia force, which act on said working machine, and counterforce from said bucket retainer, said method comprising the steps of: bringing said second boom cylinder into a floating state and expanding said first boom cylinder to raise said first boom member to near the dead point of said first boom cylinder; expanding and contracting, after said first boom cylinder has reached the vicinity of the dead point, said bucket cylinder to ensure the retaining of said bucket by said bucket retainer and, at the same time, expanding said arm cylinder with said first and second boom cylinders being brought into a floating state; further raising said first boom cylinder beyond the dead point by making use of the counterforce from said bucket retainer, and hydraulic pressures from said bucket cylinder and said arm cylinder, which act on said working machine, thereby bringing said working machine to an operational position; expanding and contracting, after completion of work, said bucket cylinder to retain said bucket on said bucket retainer, and expanding said first boom cylinder and contracting said arm cylinder, with said second boom cylinder being brought into a floating state, to move said first boom member to near the dead point of said first boom cylinder; and bringing, after said first boom member has passed the dead point of said first boom cylinder by the gravitational force acting on said working machine, said second boom cylinder into a floating state and contracting said first boom cylinder to fold said first and second boom members by making use of the gravitational force acting on said working machine and hydraulic pressure in said first boom cylinder.

* * * * *